United States Patent [19]

Hawkins

[11] 3,995,128

[45] Nov. 30, 1976

[54] PUSHBUTTON KEYBOARD SYSTEM HAVING PREFORMED RECESSED SUPPORT WITH CONTACTS MOUNTED ON FACE AND IN RECESSES

[75] Inventor: David G. Hawkins, Bristol, R.I.

[73] Assignee: Texas Instruments Incorporated, Dallas, Tex.

[22] Filed: Jan. 10, 1975

[21] Appl. No.: 535,467

[52] U.S. Cl. ..... 200/5 A; 200/159 B; 200/302; 200/306

[51] Int. Cl.[2] ..... H01H 13/52; H01H 1/60

[58] Field of Search ..... 200/5 R, 5 A, 159 B, 200/289, 302, 159 A; 174/68.5; 29/622, 630 R, 630 C

[56] References Cited

UNITED STATES PATENTS

| | | | |
|---|---|---|---|
| 2,262,777 | 11/1941 | Roper | 200/159 B |
| 3,684,842 | 8/1972 | Boulanger | 200/159 B X |
| 3,725,907 | 4/1973 | Boulanger | 200/159 B X |
| 3,749,859 | 7/1973 | Webb et al. | 200/159 B X |
| 3,769,869 | 11/1973 | Nelson, Jr. | 200/159 B X |
| 3,783,205 | 1/1974 | Boulanger | 200/159 B X |
| 3,796,843 | 3/1974 | Durkee et al. | 200/5 A |
| 3,800,104 | 3/1974 | Lien et al. | 200/5 A |
| 3,806,673 | 4/1974 | Boulanger | 200/159 B X |
| 3,808,384 | 4/1974 | Boulanger | 200/159 B X |

*Primary Examiner*—James R. Scott
*Attorney, Agent, or Firm*—John A. Haug; James P. McAndrews; Russell E. Baumann

[57] ABSTRACT

A keyboard system for an electronic pocket calculator or the like comprising an insulative substrate board having a plurality of recesses formed therein and a plurality of switch actuating elements (e.g., disks), one for each recess. The board is provided with switch contacts at each of the recesses including an outer contact on one face of the board bordering each of the recesses and an inner contact within each recess and terminals at a margin of the board for electrical interconnection to other electronic components. Each of the disks is resiliently deformable between an initial position in which its outer margin is in contact with the outer contact and in which it is clear of the inner contact and an actuated position in which the outer margin of the disk remains in contact with the outer contact and in which one point of the disk is in contact with the inner contact thereby to complete a circuit between the inner and outer contacts. A sheet of flexible insulative material is adhesively bonded to the one face of the board and to the outer faces of the disks for securing the disks in position relative to their respective recesses, for permitting the disks to be deformed to their actuated positions, and for sealing the disks to the board. An alternative embodiment includes a vent for each recess to enhance tactile feedback.

10 Claims, 8 Drawing Figures

PUSHBUTTON KEYBOARD SYSTEM HAVING PREFORMED RECESSED SUPPORT WITH CONTACTS MOUNTED ON FACE AND IN RECESSES

BACKGROUND OF THE INVENTION

This invention relates to a manual pushbutton keyboard system for an electronic pocket calculator, for a pushbutton telephone, or for other electrical or electronic appliances, and it is particularly concerned with such a keyboard which utilizes dished or domes disks as switch actuating elements of single-pole, single-throw (SPST) momentary switches for the keyboard.

More generally, calculator keyboards conventionally include a plurality of SPST momentary switches and a network of conductor paths on a printed circuit board leading to terminals at one margin of the board for connection of the keyboard switches to other electronic components, such as to various solid state, integrated circuit, and semi-conductor logic components within a calculator. Prior art keyboards, such as shown in the coassigned U.S. Pat. Nos. 3,684,842, 3,806,673 and 3,808,384, utilized domed disks as switch actuating elements. The disks in these prior art keyboards were conventionally retained in place relative to their respective contacts by means of an apertured retainer board having a thickness generally of the height of the domed disks, with the disks received in the apertures in the retainer board. This retainer board represented a substantial portion of the cost of the keyboard. The conductor paths in these prior art keyboards were constituted by chemically etching metal from one or both sides of a laminated insulative board in a preselected pattern. This so-called subtractive method of producing a printed circuit board is relatively slow and expensive and it poses certain ecological problems in the disposal of chemical wastes. Other keyboards are known in which disks are loosely retained in deeper recesses formed in a molded plastic substrate board. In this last-mentioned prior art keyboard, the conductor paths are applied to the substrate board by a well-known additive electroless plating process. However, the deep recesses posed a problem in plating the vertical surfaces of the recesses, and required the board to be relatively thick to accommodate the disks.

SUMMARY OF THE INVENTION

Among the many objects of this invention may be noted the provision of a keyboard system which requires a minimum number of parts; the provision of such a keyboard system in which the conductor paths may readily and inexpensively be formed on a three-dimensional surface; the provision of such a keyboard in which the switch actuating elements are retained in position in a simple and efficient manner without the use of a retainer board and in which the substrate board is of minimum thickness; and the provision of such a keyboard which is inexpensive to manufacture and easy to assemble. Other objects and features of this invention will be in part apparent and in part pointed out hereinafter.

Briefly, a keyboard system of this invention has an insulative substrate board having a plurality of recesses therein and a plurality of switch actuating elements, one for each recess. The board has switch contact means at each of its recesses and means at a margin thereof for electrical interconnection to other electronic components. Conductor paths interconnect the contact means and the interconnection means. The contact means comprises an outer contact on the face of the board bordering each recess and an inner contact within each recess. The inner contact at each recess is spaced below the level of the board. The conductor paths connect each outer and each inner contact with the interconnecting means. The conductor paths connecting the inner contacts with the interconnecting means are spaced from their respective elements. Each of the elements is resiliently deformable between an initial position in which the outer margin of the element is in contact with the outer contact and in which it is clear of the inner contact and an actuated position in which the outer margin of the element is in contact with the outer contact and in which one point of the element is in contact with the inner contact thereby to complete a circuit between the inner and outer contacts. A sheet of flexible insulative material is adhesively bonded to the board and to the outer faces of the elements for securing the elements in position relative to their respective recesses, for permitting the elements to be deformed to their actuated positions, and for sealing the actuated elements to the board. An alternative embodiment includes a vent for each recess to enhance tactile feedback.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
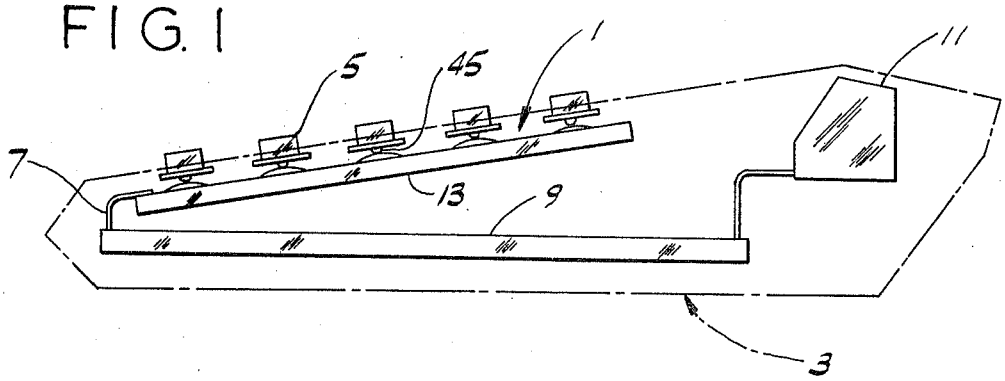
FIG. 1 is a side elevational view of a pocket calculator in which the major components of the calculator including its case, its display module, and its motherboard carrying various electronic logic components (not shown) are illustrated and in which a keyboard system of this invention is installed.

Referring now to the drawings, a keyboard system of this invention, indicated in its entirety at 1, is shown in FIG. 1 installed in an electronic pocket calculator 3. The keyboard system is actuated by manually operable pushbuttons 5 and is electrically connected by umbilical wires 7 to other electrical or electronic components, such as solid state logic components (not shown)

on a motherboard 9 within the calculator. The calculator displays its output on a light-emitting diode (LED) display module 11. The power supply for the calculator is not shown.

Figure 2:
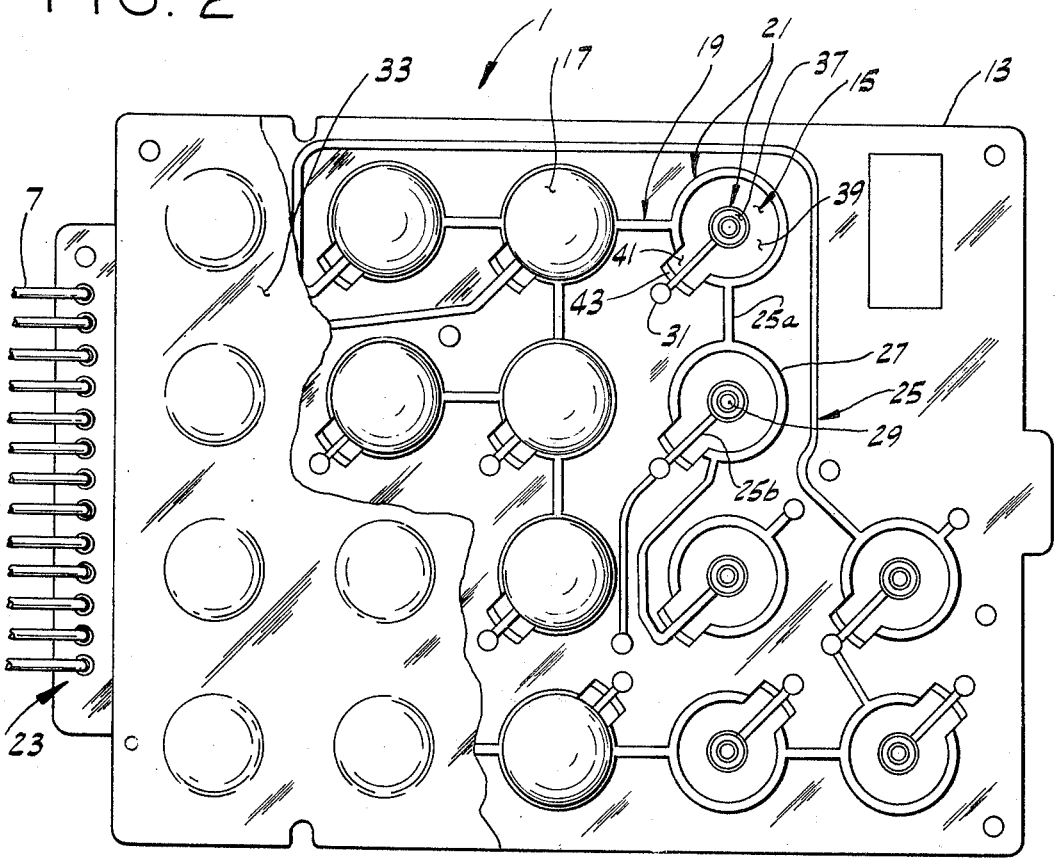
FIG. 2 is an enlarged plan view of the keyboard system of this invention with some parts broken away for clarity.
Figure 3:
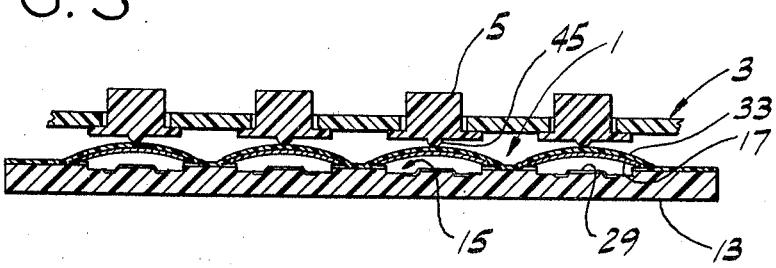
FIG. 3 is an enlarged section taken on line 3—3 of FIG. 1.

More particularly, keyboard system 1 comprises an electrically insulative substrate board 13 of a molded synthetic resin material, such as phenolic, epoxy or other suitable material. The board has an array of recesses 15 molded in one face thereof. At each recess, a switch actuating element is provided. These elements are shown to be concave-convex domed disks 17 of a resilient, electrically conductive material, such as stainless steel, phosphor bronze or the like, having a convex outer face and a concave inner face. As generally indicated at 19 in FIG. 2, so-called conductor means are provided on board 13. These conductor means are formed on the substrate board by an electroless plating metallizing process in a manner as will be described hereinafter. Conductor means 19 includes switch contact means 21 at each switch location or recess 15, terminal means 23 at one margin of board 13 for electrical interconnection to umbilical wires 7, and conductor paths 25 on both the front and back faces of the board interconnecting switch contact means 21 and terminal means 23.

Figure 5:
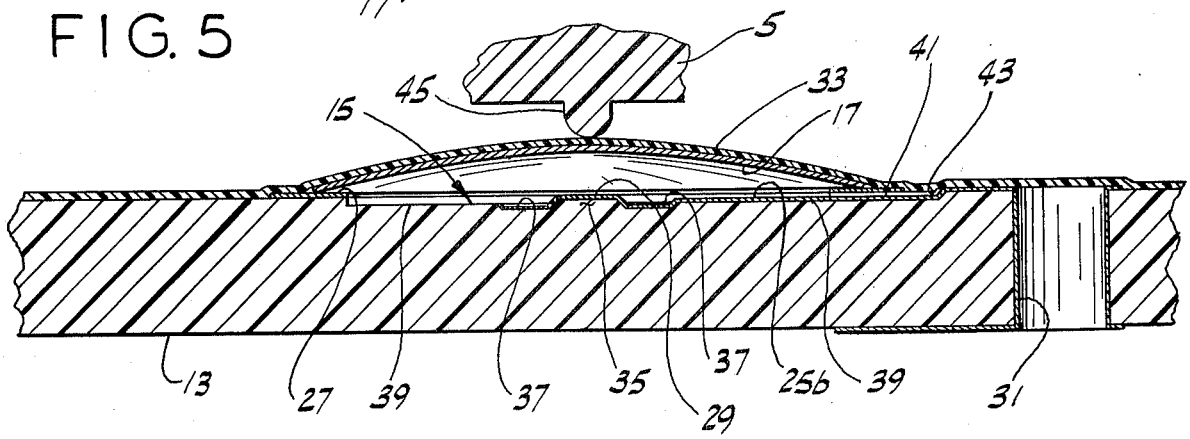
FIG. 5 is a cross section on line 5—5 of FIG. 4 illustrating details of a recess formed in the board at each switch location and showing the actuating element in its initial convex position.
Figure 6:
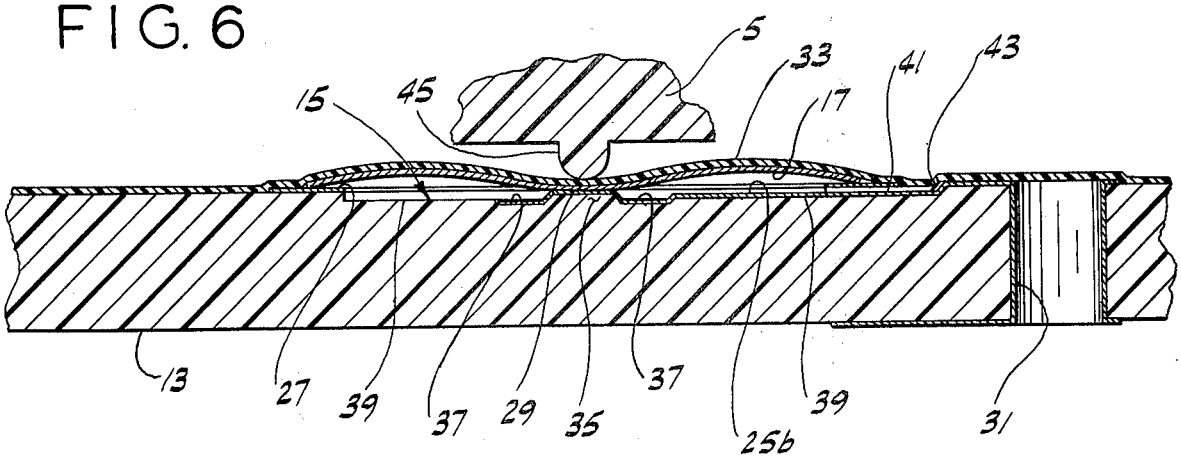
FIG. 6 is a view similar to FIG. 5 illustrating the actuating element in its overcentered actuated position.

Contact means 21 includes an outer contact surface 27 on the surface of board 13 bordering recesses 15 and an inner contact surface 29 within each recess. The outer contacts are connected to terminal means 23 by conductor paths **25*a* and the inner contact surfaces 29 are connected to the terminal means by conductor paths 25*b*. As best shown in FIGS. 5 and 6 in the areas of the disks, conductor paths 25*b* are spaced below the disks and are thus electrically insulated from the disk as will be explained in detail hereinafter. Some of the paths 25 lead to holes 31 extending through board 13. These holes may be molded into the board and have metal deposited on their inside surfaces and lead to other conductor paths on the back face of the board for connection to terminal means 23 (see FIGS. 5 and 6**).

Disks 17 are resiliently deformable from an initial position (see FIG. 5) in which the outer margin of the disk is in engagement with its respective outer contact surface 27 and in which it is clear of its respective inner contact surface 29 and an overcentered actuated position (see FIG. 6) in which a point on its initially concave face (i.e., its center) contacts its inner contact surface 29 thereby to complete a circuit between contact surfaces 27 and 29.

A sheet 33 of flexible insulative material, such as polyethylene-terephthalate, commercially available under the trade designation MYLAR from the E. I. du Pont de Nemours and Company, is adhesively bonded (as by a coating of pressure-sensitive adhesive applied to one face of the sheet) to one face of board 13 and to the outer or initially convex faces of disks 17. Thus, sheet 33 secures the disks in position on the board relative to their respective recesses 15, permits the disks to be deformed to their overcentered actuated positions, and seals the disks to the board so as to prevent dirt or other contaminates from lodging in the recesses between the disks and the contact surfaces which may deleteriously affect operation of the keyboard system.

Figure 4:
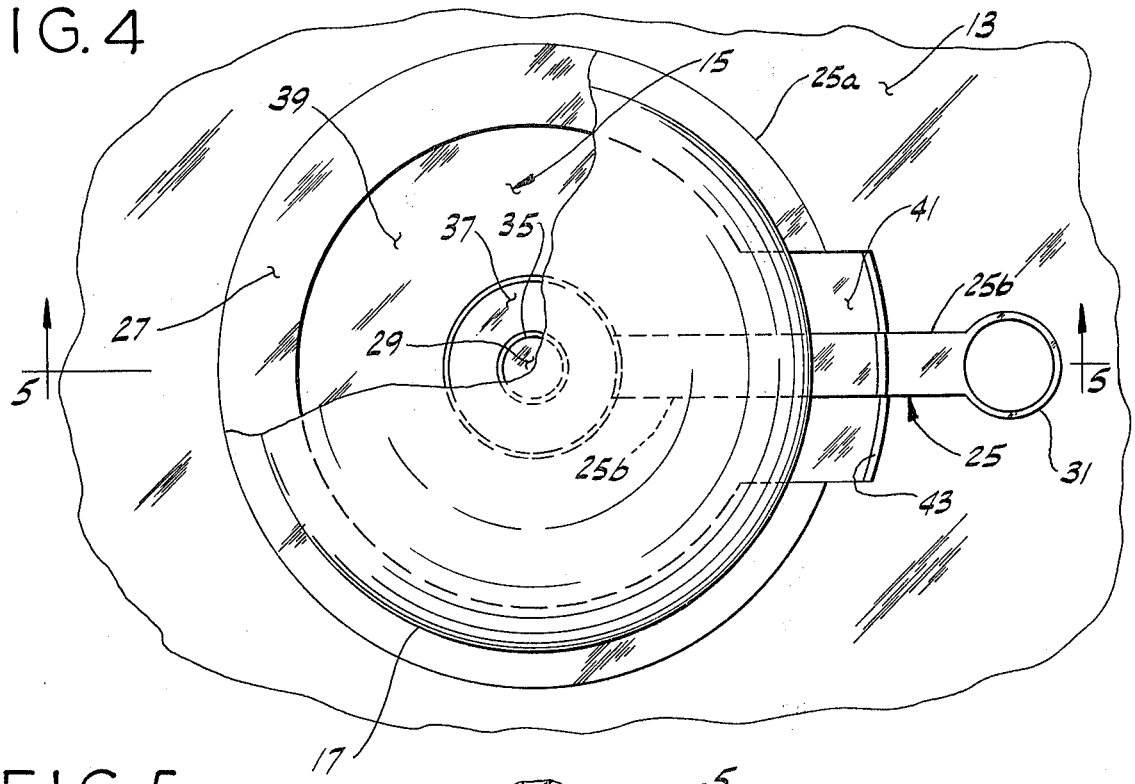
FIG. 4 is an enlarged plan view of a portion of the substrate board illustrating one switch location with parts of the switch actuating element omitted for clarity.

As best shown in FIGS. 4–6, recesses 15 are shallow relative to the domed height of disks 17. For example, disk 17 may have a domed height of 0.010 inch (0.25mm.) and recess 25 may have a maximum depth of 0.009 inch (0.23 mm.). Disks 17 are somewhat larger in diameter than recesses 15 so that the outer margin of the disk is supported on the outer contact surface 27 such that it is generally coplanar with the surface of board 13. For example, disks 17 may be 0.375 inch (9.53 mm.) in diameter and recesses 15 may have a diameter of 0.325 inch (8.18 mm.). Each recess 15 has a center portion 35 (see FIGS. 5 and 6) recessed below the level of board 13. This center portion may be spaced below the level of the board between about 0.002 inch (0.05 mm.) and 0.004 inch (0.10 mm.) and is preferably 0.003 inch (0.08 mm.). A second portion 37 surrounds center portion 35 and is recessed into the board to a substantially greater depth for forming a moat around the center portion. For example, this second portion may be recessed about 0.009 inch (0.23 mm.) below the surface of board 13. A third portion 39 surrounds the second portion and is recessed to a level intermediate center portion 35 and the second portion 37. For example, this third portion may be recessed about 0.004 inch (0.10 mm.) below the level of the surface of board 13. As best shown in FIGS. 1 and 4, recesses 15 are generally circular in plan. A fourth portion 41 of the recesses extends generally radially outwardly from the edge of the recess at one location on the recess. As best shown in FIGS. 5 and 6, this fourth portion 41 is generally at the level of third portion 39 and extends out beyond the outer margin of disk 17. At the outer end of the fourth portion, a ramp 43 inclines upwardly toward the surface of board 13. It will be noted that conductor path **25*b* in fourth portion 41 is spaced below the outer margin of disks 17 and is thus electrically insulated from the disks. Conductor path 25*b* extends up ramp 43 and may lead to an adjacent hole 31 or to other conductor paths. It will be understood that the deeper second portion 37 surrounding contact 29 and forming a moat serves as a reservoir into which dust particles and other solid contaminates may be received so as to prevent these contaminates from lodging on the upper surface of inner contact surface 29 where they could prevent electrical contact between disks 17** and the inner contact upon the disk being moved to its over centered position.

Outer contact surface 27 is shown to be a broken or open ring partially surrounding recesses 15 with its ends terminating at the edges of portion 41. As is best shown in FIGS. 4–6, conductive metal is deposited on center portion 35 and on second portion 37 to constitute inner contact surface 29.

More particularly, disks 17 are generally circular in plan and of dish-shaped cross section having a double curved outer surface, such as a segment of a spheroid, and having a generally convex upper surface of curvature when they are in their initial or rest position, this convex surface being engageable by tits 45 on pushbutton keys 5. The disk has an overcentered actuated position when its center portion is subjected to a preselected deflecting force and it automatically returns to its initial position upon removal of the deflecting force, whereby the element has a mechanical memory to return to its initial position. Of course, these actuating elements may have shapes other than those shown and described herein. Preferably, the disk undergoes a sudden deflection from its initial to its overcentered actuated position as it establishes electrical contact with its respective center contact 29. As a result of this sudden deflection, tactile feedback is provided to the operator depressing the key which may be sensed in the fingertips. Furthermore, this sudden overcentering may provide an audible signal thus indicating the pushbutton has been properly depressed to generate the desired electrical signal. In FIG. 6, it will be noted that when the disk is in its overcentered position, it is essentially flat with its center portion below its outer margin about 0.003 – 0.004 inch (0.08 – 0.10 mm.). It will be further noted that the margin of the disk is substantially coplanar with the face of board 13 and is spaced above the board only by the thickness of contact surface 27, which, for example, may be 0.0002 inch (0.005 mm.) thick.

Conductor means 19 may be applied to board 13 according to a number of known processes, but it is preferably applied by a so-called selective pattern electroless plating process, such as disclosed in U.S. Pat. No. 3,399,268. Reference may be made to this patent for details of the electroless plating process. This process is an additive metallizing process, as opposed to the subtractive or chemical etch process conventionally used to produce laminate printed circuit boards. The additive process is particularly advantageous because it enables the conductors to be applied on three-dimensional surfaces, such as on the slope sides of ramp 43 and on vertical surfaces, such as the insides of holes 31. This enables holes 31 to be molded into the board and to be made conductive (i.e., their inside surfaces metallized) quickly and inexpensively with no separate operations required. In prior laminate printed circuit boards, after the conductor paths were etched on the faces of the board, a series of holes was then drilled through the board, and metal connectors, such as staples were inserted in the holes, and soldered to the conductor paths on the front and back faces of the board, thereby to selectively interconnect conductor paths on both faces of the board. By using the electroless plating process, which the keyboard of this system permits, the expensive steps of drilling holes, inserting staples and soldering are eliminated. Also, in prior uses of electroless plating processes for selectively plating conductor patterns on three-dimensional substrate surfaces, such as on relatively deep disk retainer recesses, it was difficult to selectively plate only portions of the vertical walls of the recesses. With the keyboard system of the present invention, the requirement of a deep disk-retaining recess is eliminated thus enabling the use of electroless plating to form conductor paths on vertical surfaces, such as in moats 37 and on ramps 43 of recesses 15.

In assembling the keyboard system of this invention, the requisite number of disks 17 (e.g., 18 disks are required for the keyboard shown in FIG. 1), are arranged in a fixture (not shown), either by hand or by automatic vibratory feed equipment with their concave faces down to correspond to the location of recesses 15 in board 13. Insulative sheet 33 with a continuous layer of adhesive material on its undersurface is then placed on the fixture and the outer convex faces of the disks are adhesively gripped by the sheet. The sheet with the disks adhesively held thereby is then bonded to the face of substrate board 13 which has been previously electrolessly plated to form contact surfaces 27 and 29 and conductor paths 25. Thus, all of the disks on the sheet are simultaneously positioned relative to their respective recesses and secured in place by adhering sheet 33 to board 13.

Figure 7:
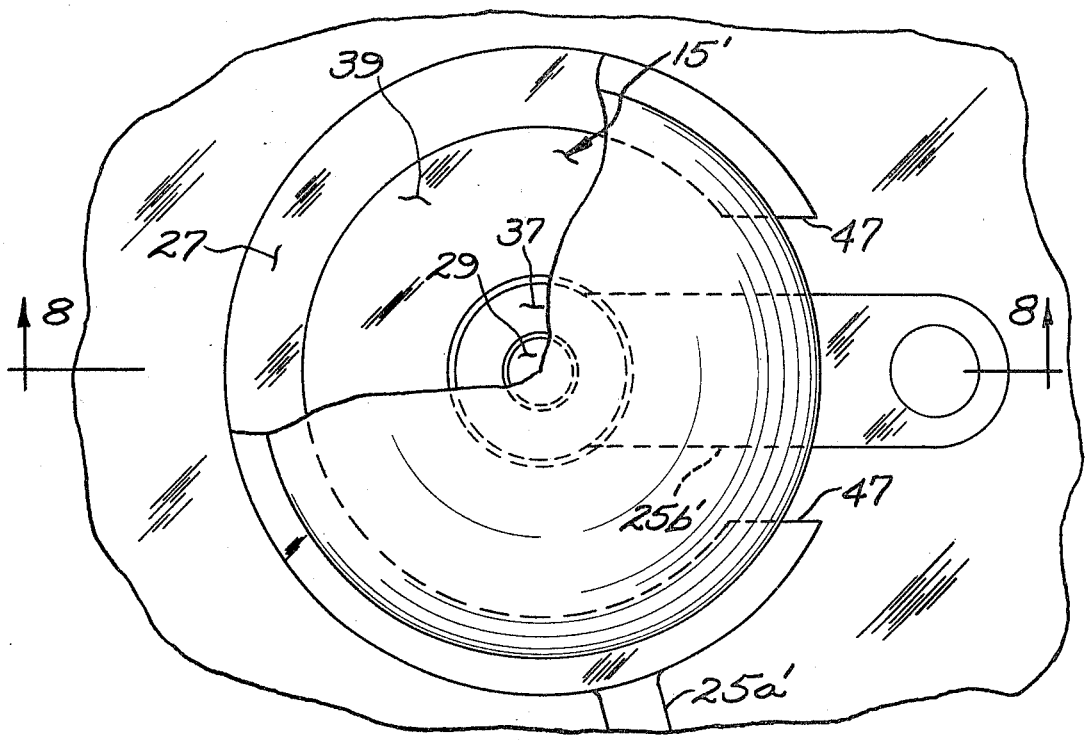
FIG. 7 is a view similar to FIG. 4 of a second embodiment of the invention.
Figure 8:
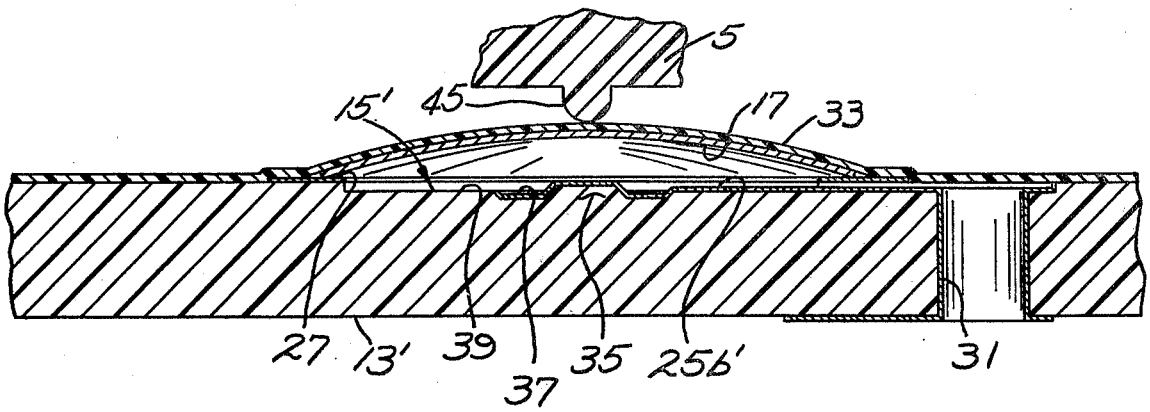
FIG. 8 is a cross section on line 8—8 of FIG. 7 illustrating details of a recess formed in the board at each switch location and showing the actuating element in its initial convex position.

In FIGS. 7 and 8 an alternative embodiment is shown in which tactile feedback or the feel of disc actuation is enhanced. In the embodiment of FIGS. 1–6 air is trapped beneath each disk and sealed therein by sheet 33 bonded to board 13. This air cushions the sudden motion of disks 17 when they are actuated thereby decreasing the tactile feedback to the operator. In the alternative embodiment recessed portion 37 extends not only around contact surface 29 and recess 37 but also all the way to hole 31 so that conductor path **25*b*' is coplanar with recessed portion 39. This provides a vent channel for each disk 17 so that the body of air located beneath an unactuated disk can readily be displaced upon actuation of the disk. The width of the recess along conductor path 25*b*' and the diameter of hole 31 are sufficiently small that sheet 33 does not tend to bend into the recess and come into contact with the bottom surface thereof. On the other hand, contaminates which may find their way through hole 31 will tend to be caught by the sticky under surface of sheet 33 preventing them from getting between disks 17 and their respective contact surfaces. In order to ensure adequate electrical spacing between the inner and outer contact surface, outer contact surface 27 is preferably terminated on either side of conductor path 25*b*' a slight distance as shown at 47**.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A keyboard system for an electronic pocket calculator or the like comprising:

an electrically insulative substrate board having a plurality of recesses therein;

a plurality of switch actuating domed disk elements, one for each recess;

switch contact means at each of said recesses, means at a margin of said board for electrical interconnection to other electronic components, and conductor paths interconnecting said contact means and the interconnection means, said contact means comprising an outer contact on one face of said board bordering each said recess and an inner contact within each said recess, said inner contact being spaced below the level of said one face of said board, said recess including a portion extending outwardly beyond the margin of said element when said element is positioned at its respective recess, said conductor paths connecting the inner contact and the interconnecting means being located in said portion below the margin and being spaced from the respective elements, said outer margin of each of said elements being supported by said outer contact on said one face of said substrate board and said outer margin being subtantially coplanar with said one face of said board, each of said elements being resiliently deformable between an initial position in which the outer margin of said element is in contact with said outer contact and in which it is clear of said inner contact and an actuated position in which the outer margin of the element is in contact with the outer contact and in which at least one point of the element is in contact with the inner contact thereby to complete a circuit between the inner and outer contacts; and means for securing the elements in position relative to their respective recesses, for permitting the elements to be deformed to their actuated position, and for sealing the elements to said one face of the board.

2. A keyboard system as set forth in claim 1 in which the means for securing said elements in position relative to their respective recesses is a sheet of flexible insulative material bonded to the board and the outer faces of the elements.

3. A keyboard system as set forth in claim 1 wherein each of said actuating elements is a generally circular-in-plan domed disk having a convex outer face and a concave inner face, said concave inner face being spaced from said inner contact when the disk is in its initial or first position and being in contact with both said inner and outer contacts when it is in its second or actuated position.

4. A keyboard system as set forth in claim 1 wherein said outer contact is an open ring of conductive material on said one face of the board partially surrounding said recess, and wherein said inner contact is substantially at the center of the recess.

5. A keyboard system as set forth in claim 1 in which a vent is provided for each recess so that air located beneath an actuating element can be readily displaced upon actuation of the actuating element.

6. A keyboard system for an electronic pocket calculator or the like comprising:

an electrically insulative substrate board having a plurality of recesses therein, each said recess comprises a first or center portion recessed into the board below one face of the board, a second portion surrounding the center portion and recessed into the board below the level of said center portion, a third portion surrounding said second portion and recessed into said board to a level intermediate said center and said second portions, said first, second and third portions being generally circular in plan, and a fourth portion extending generally radially outwardly beyond said third portion and beyond the margin of said disk below the level of said one face of the board;

a plurality of switch actuating elements, one for each recess;

switch contact means at each of said recesses, means at a margin of said board for electrical interconnection to other electronic components, and conductor paths interconnecting said contact means and the interconnection means, said contact means comprising an outer contact on said one face of said board bordering each said recess and an inner contact within each said recess, said inner contact being spaced below the level of said one face of said board, said conductor paths being spaced from the respective elements, said outer margin of each of said elements being supported by said outer contact on said one face of said substrate board and said outer margin being substantially coplanar with said one face of said board, each of said elements being resiliently deformable between an initial position in which the outer margin of said element is in contact with said outer contact and in which it is clear of said inner contact and an actuated position in which the outer margin of the element is in contact with the outer contact and in which at least one point of the element is in contact with the inner contact thereby to complete a circuit between the inner and outer contacts; and means for securing the elements in position relative to their respective recesses, for permitting the elements to be deformed to their actuated position, and for sealing the elements to said one face of the board.

7. A keyboard system as set forth in claim 6 wherein said inner contact comprises a layer of electrically conductive material on said center portion, and wherein said conductor path connecting the inner contact with the interconnecting means is a path of electrically conductive material extending from said electrically conductive material on said center portion across said second and third portions and along the bottom of said fourth portion, the latter having an inclined ramp at its outer end, and said electrically conductive material extending up this ramp for interconnection to conductor paths on said one face of said substrate board.

8. A keyboard system as set forth in claim 7 wherein said board is molded of a synthetic resin material.

9. A keyboard system as set forth in claim 6 wherein said center portion is spaced below said one surface of said board from about 0.002 inch (0.05 mm.) to about 0.004 inch (0.10 mm.) whereby, as said disk member moves to its actuated position its center portion moves over center and abruptly moves below the level of its margins supported on one surface of the board for engagement with said inner contact.

10. A keyboard system as set forth in claim 9 wherein the outer diameter of said disk is approximately ⅜ inch (9.5 mm.), and wherein said inner contact is spaced below said one surface of said board approximately 0.003 inch (0.08 mm.).

* * * * *